US010463899B2

(12) United States Patent
Cooley

(10) Patent No.: US 10,463,899 B2
(45) Date of Patent: Nov. 5, 2019

(54) FIRE-EXTINGUISHING APPARATUS

(71) Applicant: Raymond Cooley, Midlothian, TX (US)

(72) Inventor: Raymond Cooley, Midlothian, TX (US)

( * ) Notice: Subject to any disclaimer, the term of this patent is extended or adjusted under 35 U.S.C. 154(b) by 9 days.

(21) Appl. No.: 14/689,226

(22) Filed: Apr. 17, 2015

(65) Prior Publication Data

US 2016/0303408 A1 Oct. 20, 2016

(51) Int. Cl.
*A62C 2/00* (2006.01)
*A62C 8/04* (2006.01)

(52) U.S. Cl.
CPC ..... *A62C 8/04* (2013.01)

(58) Field of Classification Search
CPC ..... A62C 8/00; A62C 3/02; A01B 49/027; A01B 23/06; A01B 15/16; A01B 21/08; A01B 21/086; A01B 33/024; A01B 1/02; A01B 1/06; A01B 1/16; A01B 73/02; A01B 73/04; A01B 7/00; A01C 7/02
USPC ..... 169/46; 172/371; 431/144, 146, 149, 431/152
See application file for complete search history.

(56) References Cited

U.S. PATENT DOCUMENTS 1,055,044 A * 3/1913 Hollander ..... A01B 1/022 137/901
3,000,451 A * 9/1961 Adams ..... A01B 1/16 172/372
4,475,757 A * 10/1984 Glock ..... A01B 1/022 16/429
5,105,493 A * 4/1992 Lugtenaar ..... A01D 11/00 15/141.1
6,289,540 B1 * 9/2001 Emonds ..... A01B 1/022 15/141.1
7,406,975 B1 * 8/2008 Carrier, Jr. ..... E04H 12/2261 135/16
2007/0000227 A1 * 1/2007 Mazar ..... A01D 7/00 56/400.01

FOREIGN PATENT DOCUMENTS

WO WO 2008104617 A1 * 9/2008 ..... A01B 1/00

OTHER PUBLICATIONS http://web.archive.org/web/20081004012819/http://en.wikipedia.org/wiki/Fire_flapper_(tool).*
US Department of Agriculture http://www.fs.usda.gov/detail/hoosier/learning/history-culture/?cid=fsbdev3_017461.*

* cited by examiner

*Primary Examiner* — Arthur O Hall
*Assistant Examiner* — Adam J Rogers
(74) *Attorney, Agent, or Firm* — Fish & Richardson P.C.

(57) ABSTRACT

An example of a fire-extinguishing apparatus includes a plate member including a convex front surface configured to be exposed to fire, and a concave rear surface. The apparatus includes a handle member including a first end and a second end. The handle member is configured to push the plate member over the fire. A joint connects the first end of the handle member to the concave rear surface. In one example of using the apparatus, the apparatus can be placed on a location on a line of fire. By pushing the apparatus along the line of fire, the fire along the line can be mowed.

5 Claims, 6 Drawing Sheets

FIRE-EXTINGUISHING APPARATUS

TECHNICAL FIELD

This disclosure relates to extinguishing fires.

BACKGROUND

Open land with vegetation, for example, small brushes, large trees, combinations of them, or other vegetation, are fire hazards, particularly in dry, hot weather. Fire in any portion of such land can quickly spread to the rest of the land, particularly under windy conditions, and can cause significant damage to property and, worse, to people. Such lands may not always or easily be accessible to vehicles, for example, fire trucks or other vehicles, to extinguish a fire. Sometimes, a person, for example, a firefighter or other person, may need to walk to a certain location to extinguish the fire. Pressurized containers carrying fire extinguishers or other motorized equipment are available to extinguish fires. However, such equipment may be heavy and, consequently, difficult for a firefighter to carry to the location to extinguish the fire.

SUMMARY

This disclosure describes a fire-extinguishing apparatus and methods for using a fire-extinguishing apparatus.

Some aspects of the subject matter described here can be implemented as a fire-extinguishing apparatus. The apparatus includes a plate member including a convex front surface configured to be exposed to fire and concave rear surface. The apparatus includes a first end and a second end. The handle member is configured to push the plate member over the fire. The apparatus includes a joint connecting the first end of the handle member to the concave rear surface.

This, and other aspects, can include one or more of the following features. The plate member can include a continuous body. For example, the plate member can exclude any through holes other than through holes to attach the handle member to the plate member. The convex front surface that is configured to be exposed to the fire can be void of through holes. The plate member can include non-flammable material. An entirety of the plate member can be manufactured using the non-flammable material. Alternatively or in addition, the convex front surface can include the non-flammable material. Only the convex front surface can include a coating of the non-flammable material. The coating of the non-flammable material can cover less than an entirety of the convex front surface. The plate member can include metallic material. The plate member can have at least one of a circular cross-section, elliptical cross-section or a polygonal cross-section. The handle member can include an elongated tubular member. The elongated tubular member can include a telescoping tubular member. At least a portion of the handle member can include non-flammable material. The portion of the handle member that includes the non-flammable material can be nearer to the first end than to the second end. The joint can include a ball and socket joint.

Some aspects of the subject matter described here can be implemented as a method of mowing a fire. A fire-extinguishing apparatus is positioned on a location on a line of fire. The fire-extinguishing apparatus includes a plate member including a convex front surface and a concave rear surface, a handle member including a first end and a second end, and a joint connecting the first end of the handle member to the concave rear surface. The fire is mowed along the line of fire by pushing the fire-extinguishing apparatus along the line of fire.

This, and other aspects, can include one or more of the following features. To position the fire-extinguishing apparatus on the location on the line of fire, the plate member can be plated on the location on the line of fire. The convex front surface of the plate member can face the fire. The plate member can be pushed along the line of fire using the handle member. The plate member can include a continuous body void of through holes made from a non-flammable material.

Some aspects of the subject matter described here can be implemented as a method of mowing a fire. The method includes positioning a non-flammable convex front surface of a fire-extinguishing apparatus on a line of fire. The handle member is pushed to move the convex front surface along the line of fire.

This, and other aspects, can include one or more of the following features. The plate member can include a concave rear surface attached to a handle member through a joint. The plate member can include a continuous metallic body void of through holes. The handle member can include a telescoping tubular member. The joint can include a ball and socket joint.

The details of one or more implementations of the subject matter described in this specification are set forth in the accompanying drawings and the description below. Other features, aspects, and advantages of the subject matter will become apparent from the description, the drawings, and the claims.

DETAILED DESCRIPTION

This disclosure describes a fire-extinguishing apparatus and a method for using the fire-extinguishing apparatus. Compared to some fire-extinguishing equipment like fire extinguishers, the fire-extinguishing apparatus described here is lightweight. Consequently, a load that a firefighter needs to carry when walking to a location of the fire will not be significantly increased by carrying the fire-extinguishing apparatus described here. The fire-extinguishing apparatus includes mechanical components with very few moving parts. Therefore, the likelihood that the fire-extinguishing apparatus will fail during operation is small. In addition, the fire-extinguishing apparatus described here requires little to no assembly, and can be used to mow a fire without the need for any lead time to assemble or otherwise set up the apparatus.

The fire-extinguishing apparatus described here is easy to operate, as described below. For example, the inclusion of flared edges (described below) makes it easy to glide the apparatus over the fire to extinguish the fire. Thus, not only firefighters but also laypersons, for example, land owners or other laypersons, can easily use the fire-extinguishing apparatus without extensive training. Also, the method of using the fire-extinguishing apparatus described below provides an alternative to shoveling materials, for example, dirt on the fire. Thus, manual labor needed to extinguish the fire can be decreased, allowing a firefighter to be less tired and/or able to work longer.

Figure 1:
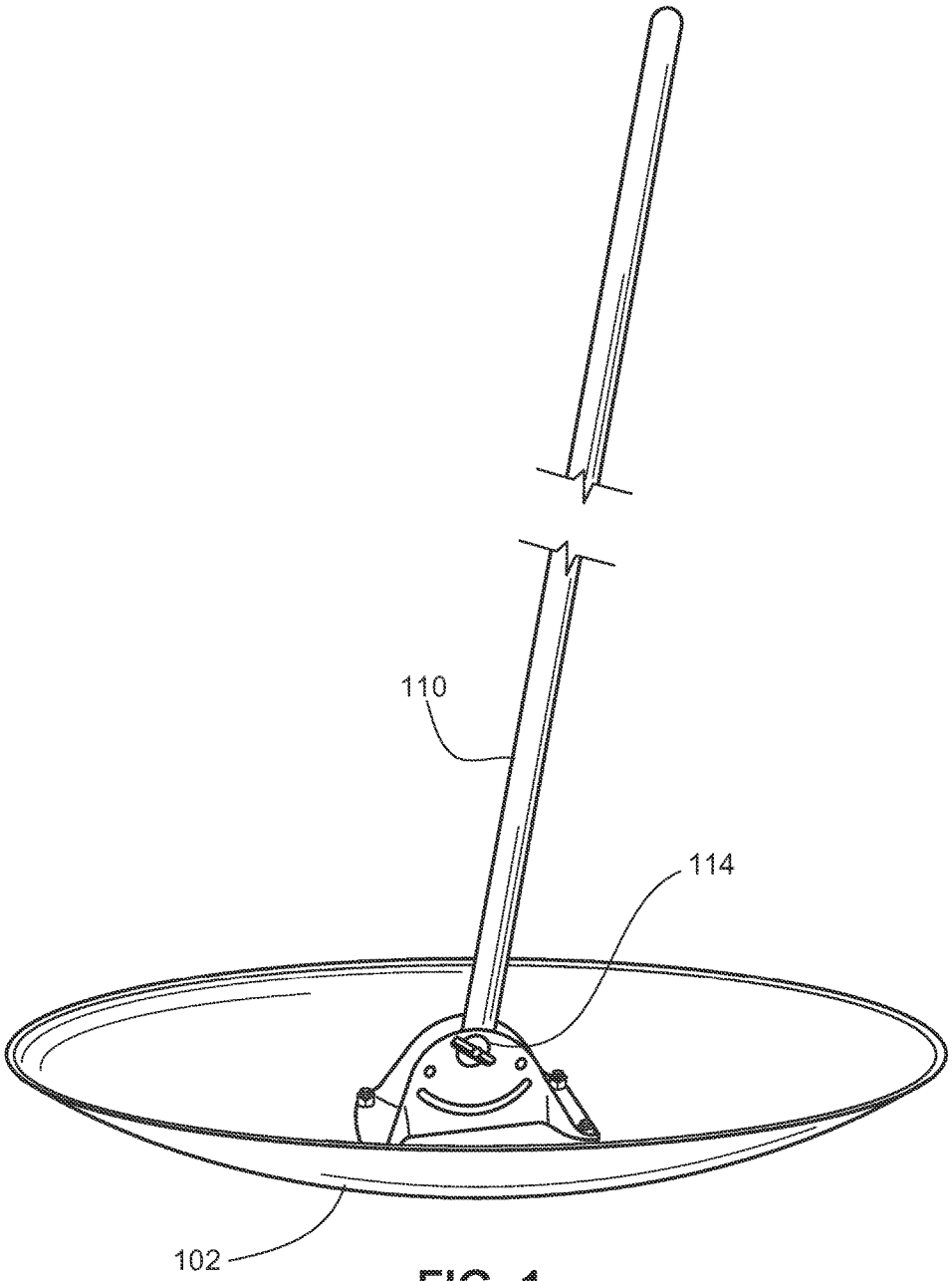
FIG. 1 is perspective view of an example of a fire-extinguishing apparatus.

FIG. 1 is a perspective view of an example of a fire-extinguishing apparatus 100. Certain fires, for example, grass fires, brush fires, or other fires, burn in a line of fire burning out material behind the line. As described below, the apparatus 100 can be used to mow such a fire by pushing the apparatus 100 along the line of fire, thereby extinguishing the fire. The apparatus 100 includes a plate member 102, including a convex front surface 104 and a concave rear surface 106. In some implementations, the rear surface need not be concave. Instead, for example, the rear surface can be substantially flat. In such implementations, the plate member 102 can be hollow (i.e., with a convex front surface, a substantially flat rear surface and with no material in between) or solid (i.e., with a convex front surface, a substantially flat rear surface and with some material in between). The convex front surface 104 is configured to be exposed to the fire. In implementations in which the plate member 102 is solid, the material between the front and rear surfaces can include heat insulation material. The additional weight offered by a solid plate member can assist in mowing fire along a line of fire.

The apparatus 100 also includes a handle member 108, including a first end 110 and a second end 112. The handle member 108 is configured to push the plate member 102 over the fire. The apparatus 100 additionally includes a joint 114 connecting the first end 110 of the handle member 108 to the concave rear surface 106.

In some implementations, the plate member 102 is a continuous body. For example, the convex front surface 104 configured to be exposed to the fire is void of through holes. That is, the plate member 102 does not include any through holes between the convex front surface 104 and the concave rear surface 106. In some implementations, the plate member 102 is not a continuous body. For example, some portions of the plate member 102 can include some through holes. The holes may be too small or too few (or both) for the fire to pass through the plate member 102. Some of the holes may be used, for example, to connect the plate member 102 to the handle member 108. In some implementations, the plate member 102 can include some recesses, i.e., non-through holes, in the convex front surface 104.

In some implementations, the plate member 102 can include non-flammable material. An example of a non-flammable material include a material that does not catch on fire. The non-flammable material can be a synthetic material (for example, a polymer), naturally occurring material, combinations of them, or other non-flammable material. A non-flammable material does not exclude materials that are affected by heat. For example, the non-flammable material can include a metal, for example, aluminum, steel, iron, or other metal. A metallic plate member can be mowed over a grass fire to extinguish the fire, although the metallic plate member will absorb heat from and be affected by the grass fire. Also, a non-flammable material does not exclude materials that are flammable at temperatures higher than the grass fire temperature. For example, a wooden plate member or a plate member including a cardboard sheet may be flammable at certain temperatures. Nevertheless, such plate members can extinguish a grass fire as long as the grass fire temperature is less than the temperature at which such plate members become flammable.

For example, an entirety of the plate member 102, i.e., the convex front surface 104, the concave rear surface 106 and everything in between, can be manufactured using the non-flammable material. Optionally, the handle member 108, the joint 114, another portion of the apparatus 100, or combinations of some or all of them can also be manufactured using a non-flammable material. For example, the entirety of the plate member 102 can be metallic and the handle member 108 can be a polymer so that the handle member does not become too hot to handle while mowing the fire.

In another example, only the convex front surface 104 can include the non-flammable material. Because only the convex front surface 104 directly contacts the fire, the remainder of the apparatus 100 need not include non-flammable material. In some implementations, a coating of the non-flammable material can be positioned (for example, sprayed, glued, or otherwise positioned) on the convex front surface 104. The coating can cover an entirety of or less than an entirety of the convex front surface 104. For example, the coating can cover only the portion of the convex front surface 104 that contacts the fire. In some implementations, the plate member 102 can include a non-flammable material and the coating.

Figure 2A:
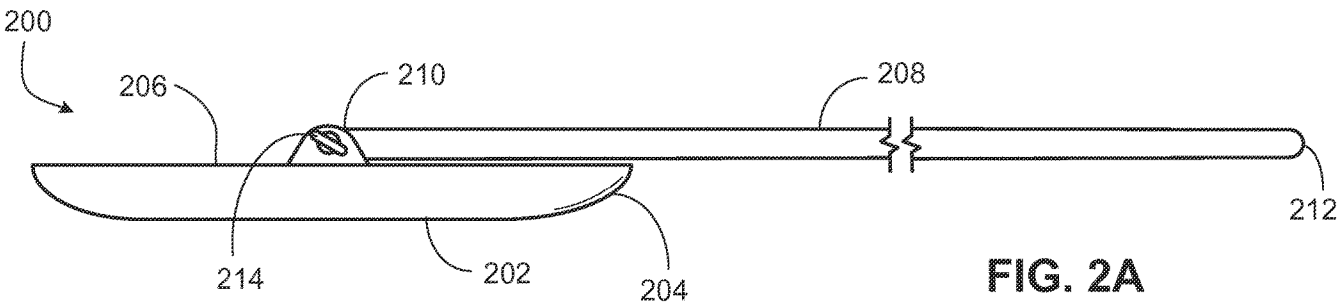
FIG. 2A is a side view of an example of a fire-extinguishing apparatus.
Figure 2B:
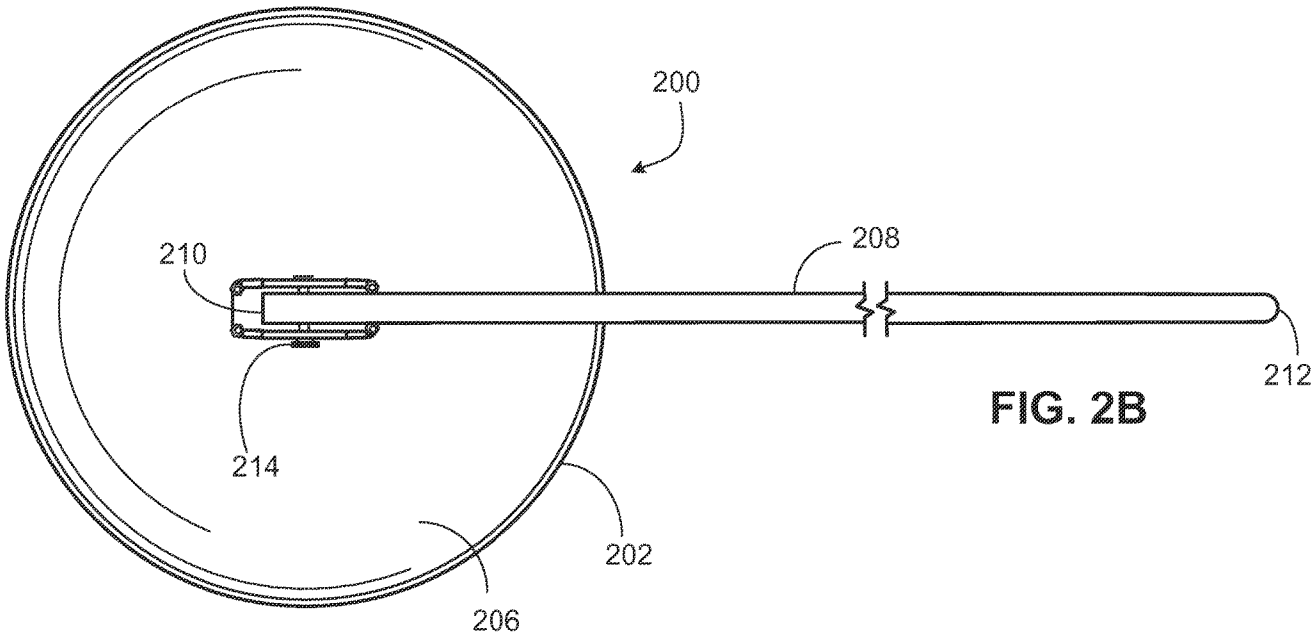
FIG. 2B is a top view of an example of a fire-extinguishing apparatus.
Figure 2C:
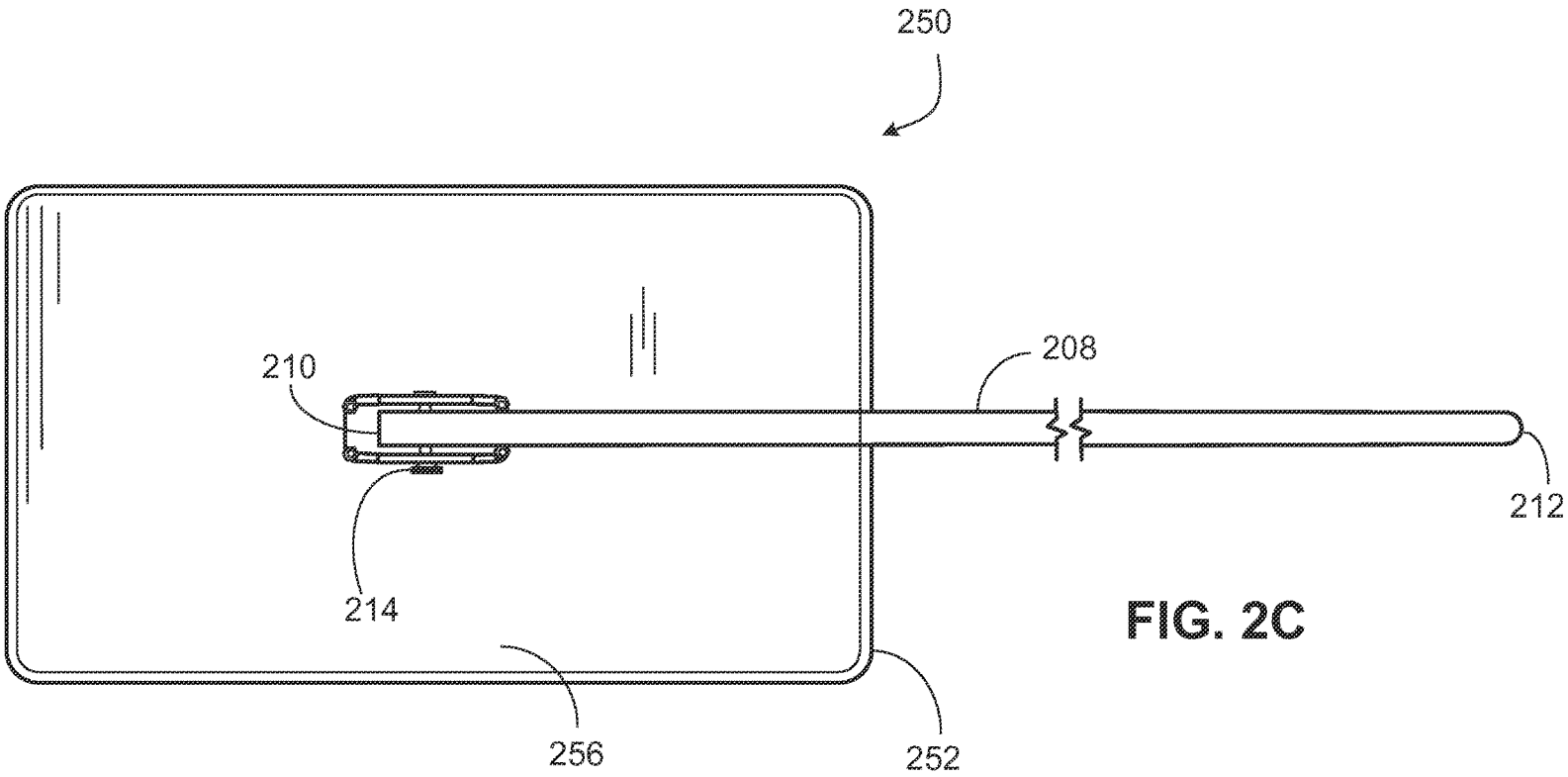
FIG. 2C is a top view of an example of a fire-extinguishing apparatus.
Figure 5:
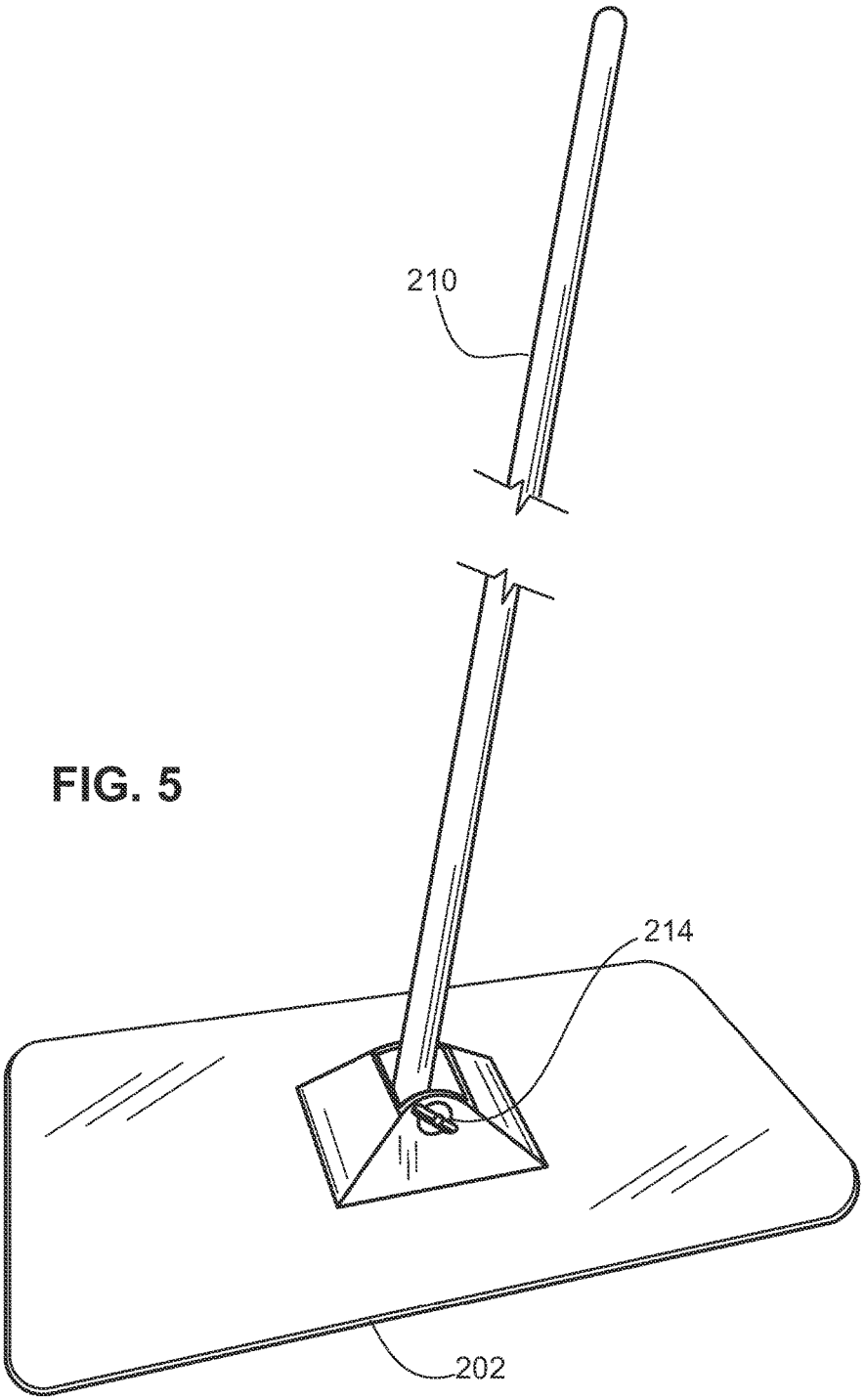
FIG. 5 is a schematic diagram of an example of a fire-extinguishing apparatus.

FIG. 2A is a side view of an example of a fire-extinguishing apparatus 200, which is substantially similar to the fire-extinguishing apparatus 100. FIG. 2B is a top view of an example of the fire-extinguishing apparatus 200. The fire-extinguishing apparatus 200 includes a plate member 202, which is substantially similar to the plate member 102. In some implementations, the plate member 202 can include a front surface 204 having a substantially flat front surface with flared edges 203*a*, 203*b*. The plate member 202 can include a rear surface 206 that is substantially flat or concave similar to the concave rear surface 106. The plate member 202 (or the plate member 102) can have a substantially circular cross-section as shown in FIG. 2B. Alternatively, the plate member 202 (or the plate member 102) can have an elliptical cross-section, a polygonal cross-section, or other geometric or non-geometric cross-section. A top view of an example of a fire-extinguishing apparatus 250 having a plate member 252 with a rectangular cross-section is shown in FIG. 2C and FIG. 5. The plate member 252 has a rear surface 256 and a front surface (not visible). The front surface of the apparatus 250 can be substantially flat with flared edges or be concave or combinations of them (i.e., include a flat portion, a flared edge portion, and a rounded portion).

In a first example, the plate member (the plate member 202 or the plate member 102) can have a circular cross-section formed into a convex disc such that an area of the convex front surface that contacts the ground when the plate member is placed on the ground is at or near a center of the circular plate member. In a second example, the plate member can have a rectangular cross-section rolled along the width (i.e., the shorter sides) such that an area of the convex front surface that contacts the ground when the plate member is placed on the ground extends along an entire length of the plate member between the two shorter sides. In a third example, the plate member can have any cross-section such that a center portion of the plate member (i.e., the portion of the plate member that is opposite to the joint) is substantially flat while the remainder of the front surface of the plate member is convex. In a fourth example, the plate member can have a rectangular cross-section folded along the width to create a sharp curve on the front surface of the plate member. The portion of the plate member that includes the sharp curve can contact the ground when the plate member is placed on the ground. Other examples of plate member cross-section and configuration are also possible.

The handle member 208 (or the handle member 108) can include an elongated tubular member that is long enough such that a user of the apparatus 200 (or 100) need not bend to cause the plate member 202 (or the plate member 102) to contact the ground. In some implementations, the handle member 208 (or the handle member 108) can include a telescoping tubular member of adjustable length. As described above, at least a portion of the handle member 208 (or the handle member 108) can include non-flammable material. In some implementations, the portion of the handle member 208 (or the handle member 108) that includes the non-flammable material can be nearer to the first end 210 (or the first end 110) than to the second end 212 (or the second end 112).

In some implementations, the joint 214 (or the joint 114) can include a ball and socket joint, a swivel joint, or other joint that will provide a range of motion to the handle member 208 (or the handle member 108). For example, the ball and socket joint can allow the user of the apparatus 200 (or apparatus 100) to change the direction in which the plate member 202 (or the plate member 102) is pushed without having to lift the plate member from the ground or swiveling the plate member itself.

Figure 3:
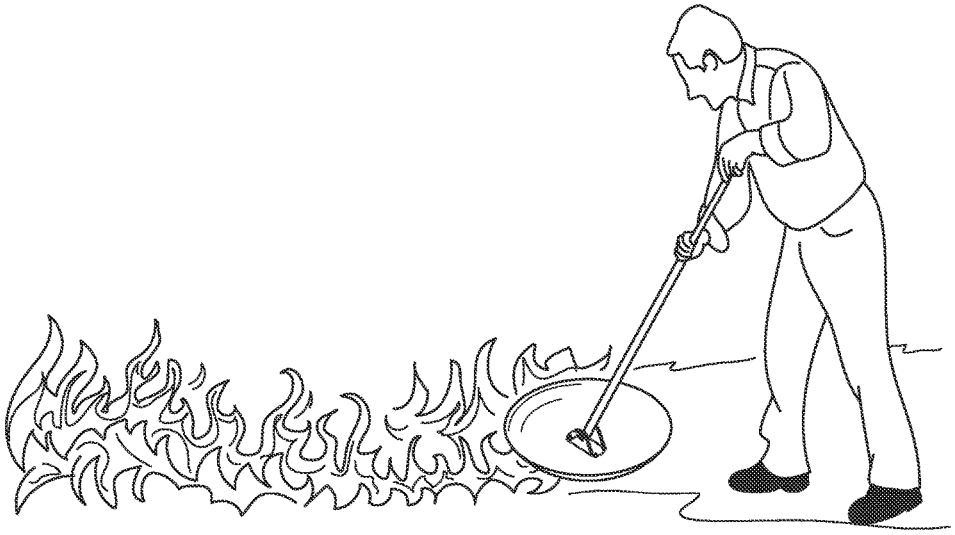
FIG. 3 is a schematic diagram of an example of a fire-extinguishing apparatus being used to mow a grass fire.

FIG. 3 is a schematic diagram of an example of a fire-extinguishing apparatus being used to mow a grass fire. The fire-extinguishing apparatus shown in FIG. 3 can be substantially similar either to the apparatus 100, the apparatus 200, or the apparatus 250. In operation, a user can position the plate member of the apparatus on any location in a brush fire or a grass fire. For example, the user can position the plate member on an edge of the fire. The front surface of the plate member can contact the ground. The user can then hold the second end of the handle member. To do so, the user can extend the telescoping tubular member included in the handle member. Using the handle member, the user can push the plate member along the line of fire, gliding the plate member over the line of fire. The flared ends of the plate member or the convex front surface facilitates pushing the plate member over the line of fire. In another example, the user can stand next to the line of fire, plate the plate member on the line of fire and swing the plate member from side to side on the line of fire, thereby smothering the fire.

Figure 4:
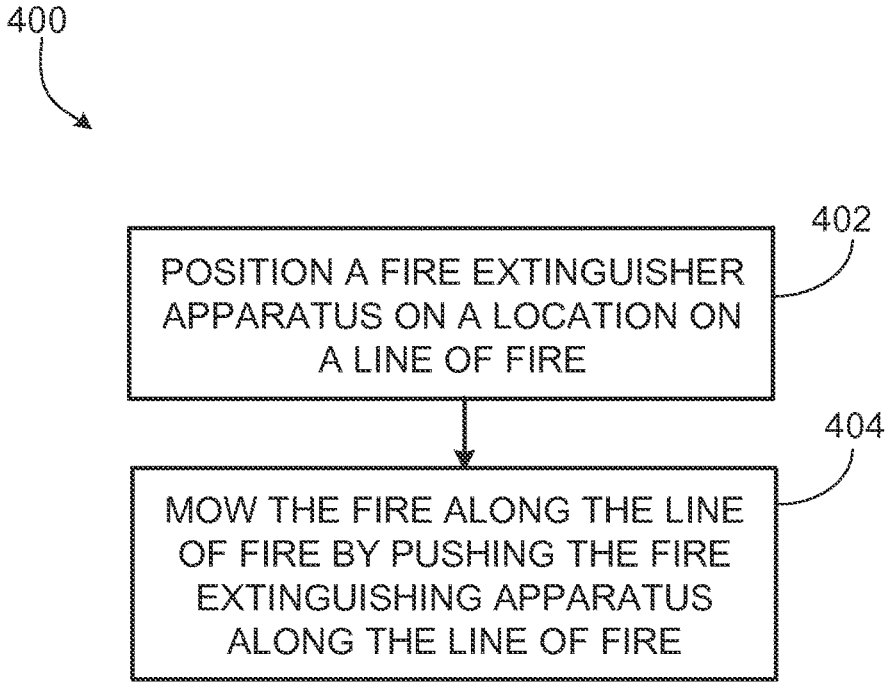
FIG. 4 is a flowchart of an example method for using an example of a fire-extinguishing apparatus.

FIG. 4 is a flowchart of an example method 400 for using an example of a fire-extinguishing apparatus. The example method 400 can be performed by a user of the fire-extinguishing apparatus to mow a fire. At 402, the fire-extinguishing apparatus can be positioned on a location on a line of fire. At 404, the fire can be mowed along the line of fire by pushing the fire-extinguishing apparatus along the line of fire. As described above, positioning the plate member on the location on the line of fire can include positioning the convex front surface of the plate member to face the fire. The plate member can be pushed along the line of fire using the handle member.

Thus, particular implementations of the subject matter have been described. Other implementations are within the scope of the following claims.

What is claimed is:

1. A method of mowing a fire, the method comprising:

positioning a fire-extinguishing apparatus on a location on a line of fire, the fire-extinguishing apparatus comprising:

a plate member comprising a convex front surface and a concave rear surface, wherein the plate member has a circular cross-section;

a handle member comprising a first end and a second end; and a joint connecting the first end of the handle member to the concave rear surface; and applying a force to the geometric center of the concave rear surface using the handle member to push the fire-extinguishing apparatus along the line of fire.

2. The method of claim 1, wherein positioning the fire-extinguishing apparatus on the location on the line of fire comprises:

positioning the plate member on the location on the line of fire, wherein the convex front surface of the plate member faces the fire;

pushing the plate member along the line of fire using the handle member.

3. The method of claim 1, wherein the plate member comprises a continuous body void of through holes made from a non-flammable material.

4. A method of mowing a fire, the method comprising:

positioning a non-flammable convex front surface of a fire-extinguishing apparatus on a line of fire, the plate member attached to a handle member through a joint; and pushing the handle member to move the convex front surface along the line of fire.

5. The method of claim 4, wherein the plate member comprises a concave rear surface, the plate member has a circular cross-section, the plate member comprises a continuous metallic body void of through holes, wherein the handle member comprises a telescoping tubular member, and wherein the joint comprises a ball and socket joint, wherein pushing the handle member comprises applying a force to a geometric center of the concave rear surface using the handle member.

* * * * *